US010315124B2

(12) United States Patent
Verfuerth

(10) Patent No.: US 10,315,124 B2
(45) Date of Patent: Jun. 11, 2019

(54) TRACK TOY

(71) Applicant: Richard Verfuerth, Gaithersburg, MD (US)

(72) Inventor: Richard Verfuerth, Gaithersburg, MD (US)

( * ) Notice: Subject to any disclaimer, the term of this patent is extended or adjusted under 35 U.S.C. 154(b) by 257 days.

(21) Appl. No.: 15/348,000

(22) Filed: Nov. 10, 2016

(65) Prior Publication Data

US 2018/0126291 A1 May 10, 2018

(51) Int. Cl.
*A63H 18/08* (2006.01)
*A63H 21/04* (2006.01)

(52) U.S. Cl.
CPC ..... *A63H 18/08* (2013.01); *A63H 21/04* (2013.01)

(58) Field of Classification Search
CPC ..... B61B 13/00; B61B 13/10; B61B 13/12; A63H 18/00; A63H 18/12; A63H 19/00; A63H 19/02; A63H 19/24; A63H 19/34; A63H 19/36
See application file for complete search history.

(56) References Cited

U.S. PATENT DOCUMENTS

| | | | | |
|---|---|---|---|---|
| 1,885,662 | A | 11/1932 | Whitehorn | |
| 4,231,294 | A * | 11/1980 | Arzoumanian | A63H 19/10 104/138.1 |
| 5,626,504 | A | 5/1997 | Liu | |
| 6,227,932 | B1 | 5/2001 | Ngai | |
| 6,398,120 | B1 | 6/2002 | Klein | |
| 7,025,656 | B2 | 4/2006 | Bailey | |
| 8,192,246 | B2 | 6/2012 | Ostendorff et al. | |
| D712,491 | S | 9/2014 | Hornsby et al. | |

* cited by examiner

*Primary Examiner* — Robert J McCarry, Jr.

(57) ABSTRACT

A track toy for entertainment includes a tube that defines an internal space. A rail is coupled to the tube and is positioned in the internal space. The rail is configured to couple to a source of electric power. A vehicle is slidably coupled to the rail. A roller is coupled to a bottom of the vehicle. A motor is coupled to and is positioned in the vehicle. The motor is operationally coupled to the rail and the roller. The roller is positioned on the vehicle such that the roller is positioned to rollably couple the vehicle to the tube. The motor is positioned to motivate rotation of the roller such that the vehicle is compelled along the rail within the internal space.

15 Claims, 5 Drawing Sheets

TRACK TOY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to track toys and more particularly pertains to a new track toy for entertainment.

BRIEF SUMMARY OF THE INVENTION

An embodiment of the disclosure meets the needs presented above by generally comprising a tube that defines an internal space. A rail is coupled to the tube and is positioned in the internal space. The rail is configured to couple to a source of electric power. A vehicle is slidably coupled to the rail. A roller is coupled to a bottom of the vehicle. A motor is coupled to and is positioned in the vehicle. The motor is operationally coupled to the rail and the roller. The roller is positioned on the vehicle such that the roller is positioned to rollably couple the vehicle to the tube. The motor is positioned to motivate rotation of the roller such that the vehicle is compelled along the rail within the internal space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
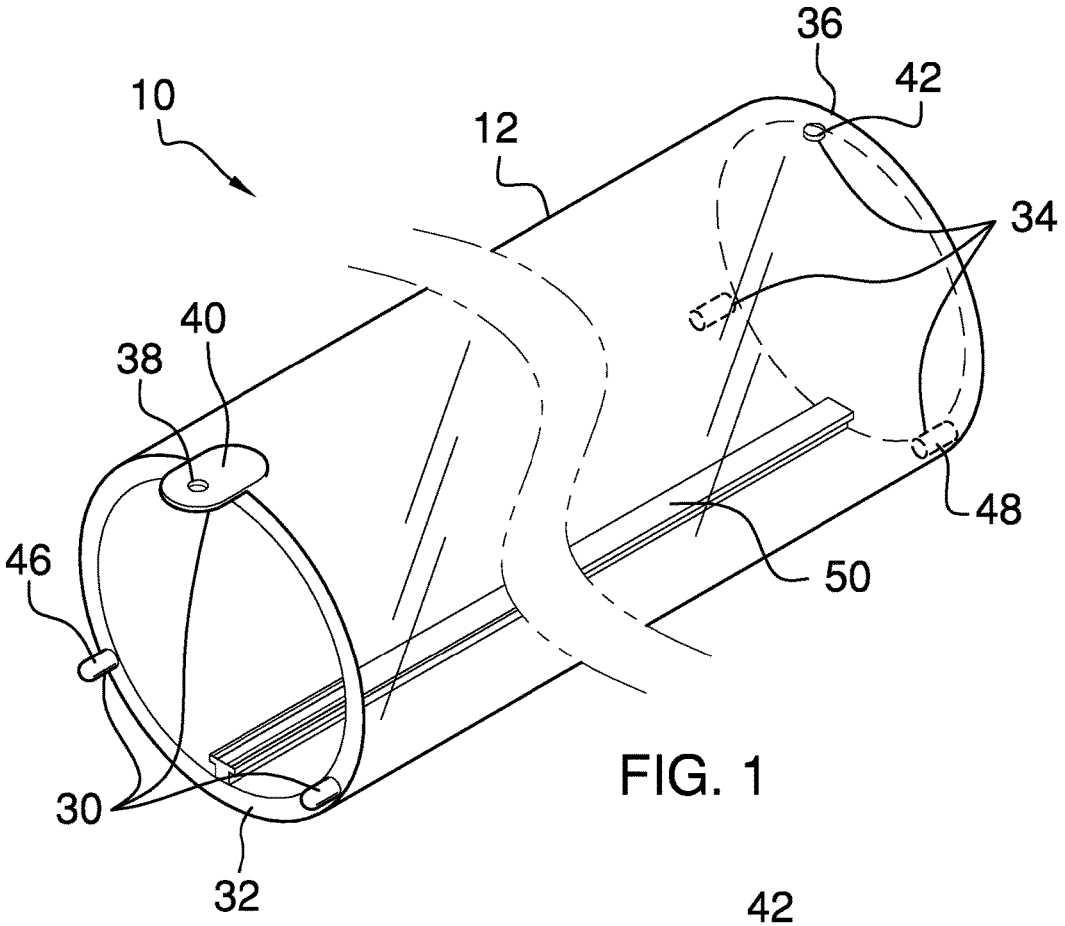
FIG. 1 is an isometric perspective view of a track toy according to an embodiment of the disclosure.
Figure 2:
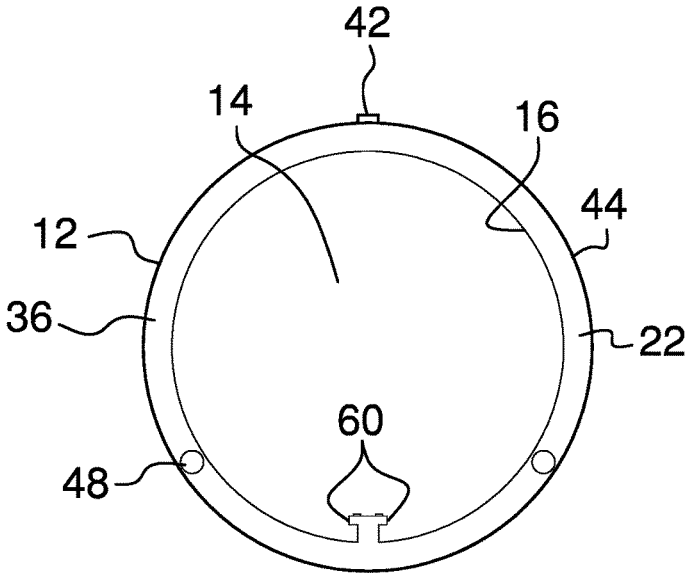
FIG. 2 is an end view of an embodiment of the disclosure.
Figure 3:
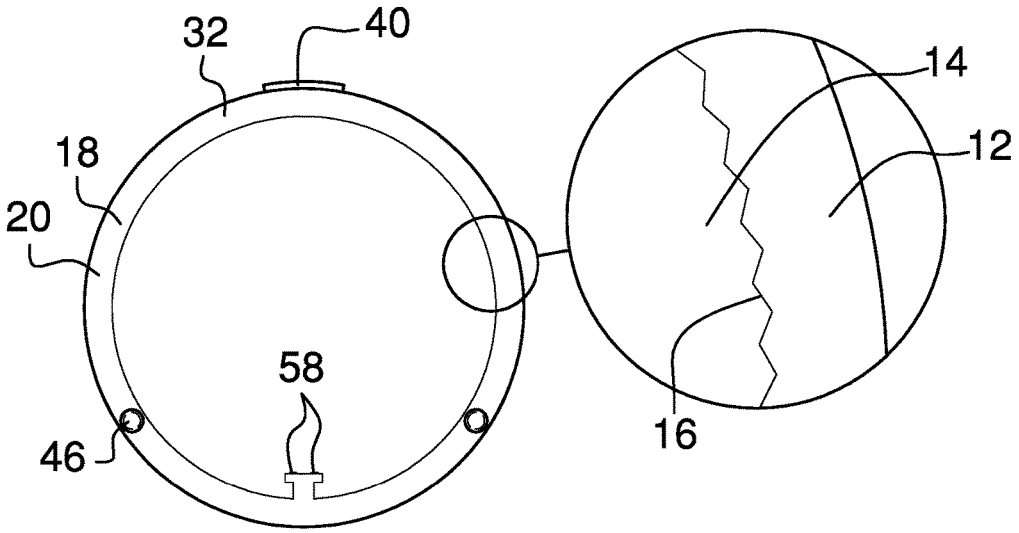
FIG. 3 is an end view of an embodiment of the disclosure.
Figure 4:
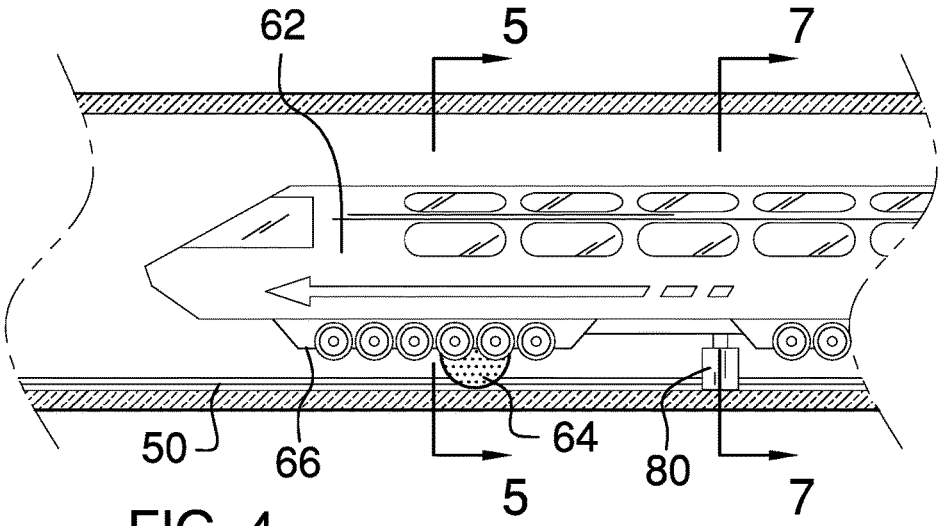
FIG. 4 is a cross-sectional view of an embodiment of the disclosure.
Figure 5:
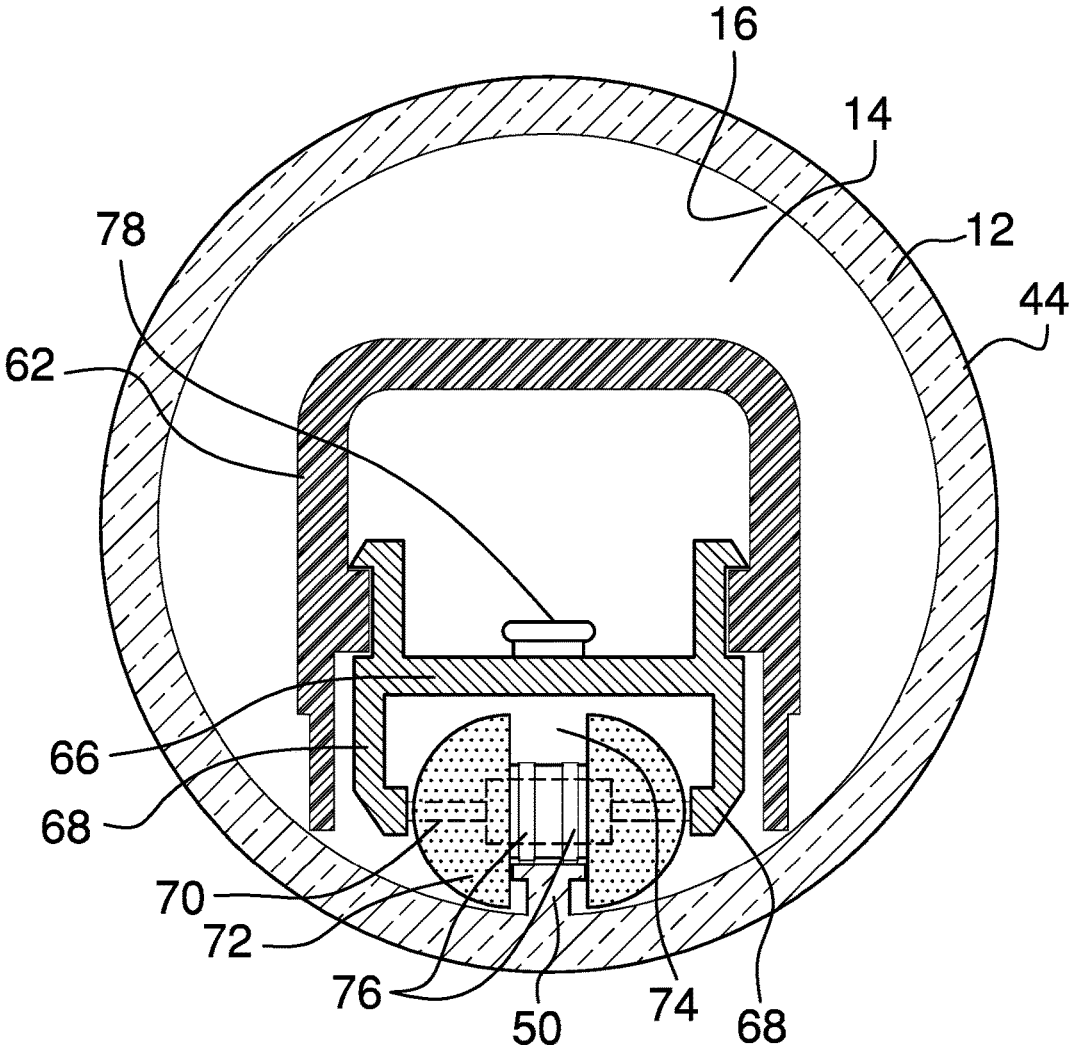
FIG. 5 is a cross-sectional view of an embodiment of the disclosure.
Figure 6:
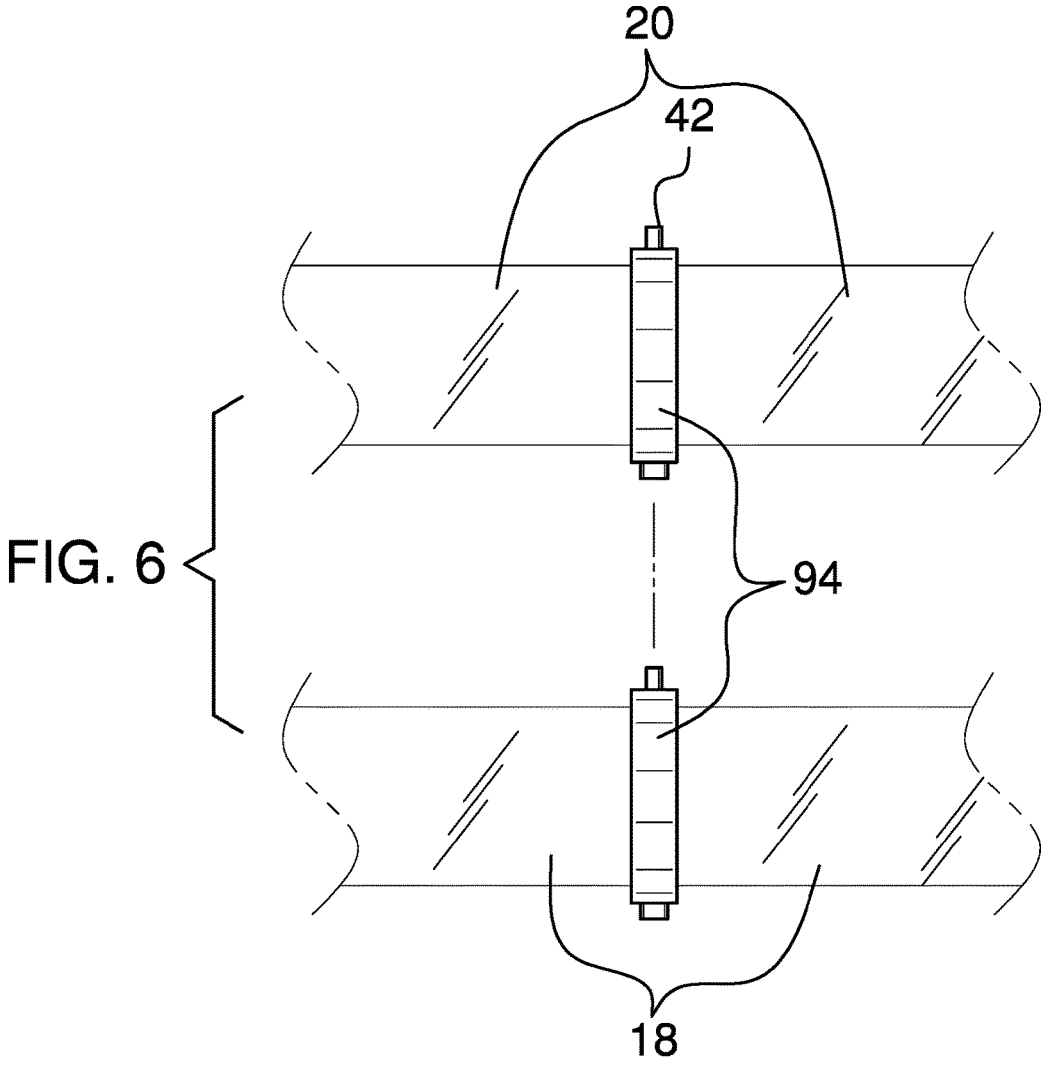
FIG. 6 is a detail view of an embodiment of the disclosure.
Figure 7:
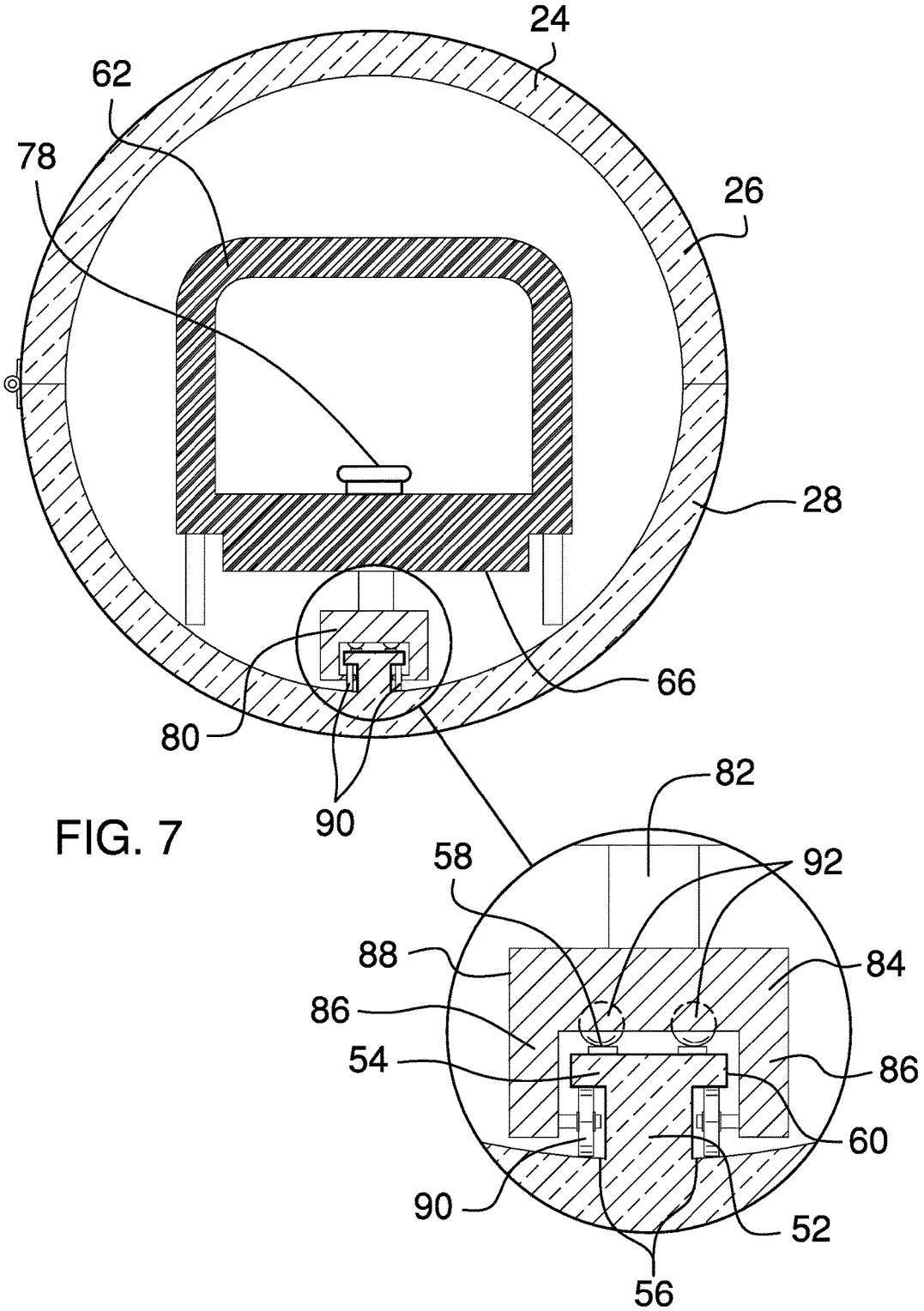
FIG. 7 is a cross-sectional view of an embodiment of the disclosure.

With reference now to the drawings, and in particular to FIGS. 1 through 7 thereof, a new track toy embodying the principles and concepts of an embodiment of the disclosure and generally designated by the reference numeral 10 will be described.

As best illustrated in FIGS. 1 through 7, the track toy 10 generally comprises a tube 12 that defines an internal space 14. The tube 12 that has an interior surface 16. In one embodiment, the interior surface 16 is textured. The tube 12 comprises a plurality of interlocking sections 18. The plurality of interlocking sections 18 comprises a plurality of linear segments 20 and a plurality of curved segments 22. The plurality of interlocking sections 18 is selectively positionable, such that the tube 12 is selectively shapeable.

The plurality of interlocking sections 18 comprises at least one loading segment 24. The at least one loading segment 24 is configured for opening and closing, such that the internal space 14 of the at least one loading segment 24 is accessible to a user. In one embodiment, the at least one loading segment 24 comprises a cover 26 and a base 28. In another embodiment, the cover 26 is spring-hingedly coupled to the base 28 such that the cover 26 is biased to a closed configuration. The cover 26 is positioned on the base 28 such that the cover 26 is configured for opening.

Each interlocking section 18 comprises a plurality of first couplers 30, which is coupled to a first end 32 of the interlocking section 18. A plurality of second couplers 34 is coupled to a second end 36 of the interlocking section 18. The second couplers 34 are complementary to the first couplers 30. The second couplers 34 are positioned on the second end 36 such that the second couplers 34 are positioned to couple to the first couplers 30 of an adjacently positioned interlocking section 18 to couple the interlocking sections 18.

In one embodiment, the first coupler 30 comprises a hole 38, which is positioned through a tab 40 that is coupled to and extends from the first end 32. The second coupler 34 comprises a protrusion 42 that is coupled to and extends from an exterior surface 44 of the tube 12 proximate to the second end 36. The protrusion 42 is complementary to the hole 38.

In another embodiment, the first coupler 30 comprises a pin 46 that is coupled to and extends from the first end 32. The second coupler 34 comprises a channel 48 that is positioned into the tube 12. The channel 48 extends inwardly into the tube 12 from the second end 36. The channel 48 is complementary to the pin 46.

A rail 50 is coupled to the tube 12 and is positioned in the internal space 14. The rail 50 is configured to couple to a source of electric power. In one embodiment, the rail 50 comprises a first plate 52 that is coupled to extends perpendicularly from the tube 12. A second plate 54 is coupled to the first plate 52 distal from the tube 12. The first plate 52 is positioned equally distant from opposing edges 60 of the second plate 54. The second plate 54, the first plate 52 and the interior surface 16 of the tube 12 define a pair of slots 56. Each of a pair of connectors 58 is positioned longitudinally proximate to a respective opposing edge 60 of the second plate 54.

A vehicle 62 is slidably coupled to the rail 50. In one embodiment, the vehicle 62 is train shaped. A roller 64 is coupled to a bottom 66 of the vehicle 62. The roller 64 is positioned on the vehicle 62 such that the roller 64 is positioned to rollably couple the vehicle 62 to the tube 12.

In one embodiment, the roller 64 comprises a pair of arms 68 that is coupled to and extends from the bottom 66 of the vehicle 62. An axle 70 is coupled to and extends between the arms 68 distal from the bottom 66. A drive ball 72 is coupled to the axle 70. The axle 70 is centrally positioned through the drive ball 72. A groove 74 is positioned in the drive ball 72. The groove 74 is substantially complementary to the rail 50. The groove 74 is positioned in the drive ball 72 such that the groove 74 is positioned for the rail 50 to pass through the groove 74 as the drive ball 72 rotates along the rail 50. In one embodiment, the drive ball 72 is studded, such that the drive ball 72 is positioned to grip the interior surface 16 of the tube 12.

Each of a pair of annular rings 76 is coupled the drive ball 72 within the groove 74. The annular rings 76 are metallic. Each annular ring 76 is positioned in the groove 74 such that the annular ring 76 is positioned to electrically couple to a respective connector 58 of the rail 50.

A motor 78 is coupled to and is positioned in the vehicle 62. The motor 78 is operationally coupled to the rail 50 and the roller 64.

A retainer 80 is coupled to and extends from the bottom 66 of the vehicle 62. The retainer 80 is slidably coupled to the rail 50. The retainer 80 is positioned on the vehicle 62 such that the retainer 80 is positioned to maintain the vehicle 62 on the rail 50 as the vehicle 62 is motivated along the rail 50 by the motor 78.

In one embodiment, the retainer 80 comprises a rod 82 that is coupled to and extends from the bottom 66 of the vehicle 62. A crosspiece 84 is coupled to the rod 82 distal from the vehicle 62. Each of a pair of extensions 86 is coupled to and extends from the crosspiece 84. Each extension 86 is positioned proximate to a respective opposing endpoint 88 of the crosspiece 84. Each of a pair of wheels 90 is axially coupled to a respective extension 86. The wheel 90 is positioned on the extension 86 such that the wheel 90 is positioned in a respective slot 56 to rollably couple the vehicle 62 to the rail 50.

Each of a pair of bearings 92 is coupled to the crosspiece 84 and extends to the second plate 54. The bearings 92 are positioned on the crosspiece 84 such that the bearings 92 are positioned to separate the retainer 80 from the rail 50.

In one embodiment, each of a plurality of flanges 94 is coupled to and extends from the first end 32 of a respective interlocking section 18. The flange 94 is positioned on the first end 32 such that the flange 94 is positioned for insertion of a respective second end 36 of an adjacently positioned interlocking section 18.

The present invention also anticipates a plurality of sensors. Each sensor would be coupled to the tube 12 and positioned to detect the vehicle 62 as the vehicle 62 is motivated along the rail 50. Each sensor would be coupled to at least one of a plurality of devices external to the tube 12, such as crossing signals and warning lights. The sensors also may be configured to actuate obstacles within the tube 12.

In use, the plurality of interlocking sections 18 is selectively positionable, such that the tube 12 is selectively shapeable. The at least one loading segment 24 is configured for opening and closing such that the internal space 14 is accessible to a user. The roller 64 is positioned on the vehicle 62 such that the roller 64 is positioned to rollably couple the vehicle 62 to the tube 12. The motor 78 is positioned to motivate rotation of the roller 64 such that the vehicle 62 is compelled along the rail 50 within the internal space 14. The retainer 80 is positioned on the vehicle 62 such that the retainer 80 is positioned to maintain the vehicle 62 on the rail 50 as the vehicle 62 is motivated along the rail 50 by the motor 78.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. A track toy comprising:

a tube defining an internal space;

a rail coupled to said tube and positioned in said internal space, said rail being configured to couple to a source of electric power, said rail comprising a first plate coupled to extending perpendicularly from said tube, a second plate coupled to said first plate distal from said tube, said first plate being positioned equally distant from opposing edges of said second plate, a pair of connectors, each said connector being positioned longitudinally proximate to a respective said opposing edge, and wherein each said second plate, said first plate and said interior surface of said tube define a pair of slots;

a vehicle slidably coupled to said rail;

a roller coupled to a bottom of said vehicle, said roller comprising a pair of arms coupled to and extending from said bottom of said vehicle, an axle coupled to and extending between said arms distal from said bottom, a drive ball coupled to said axle, said axle being centrally positioned through said drive ball, a groove positioned in said drive ball, said groove being substantially complementary to said rail, wherein said groove is positioned in said drive ball such that said groove is positioned for said rail to pass through said groove as said drive ball rotates along said rail, and a pair of annular rings coupled said drive ball within said groove, said annular rings being metallic, wherein each said annular ring is positioned in said groove such that said annular ring is positioned to electrically couple to a respective said connector of said rail;

a motor coupled to and positioned in said vehicle, said motor being operationally coupled to said rail and said roller; and wherein said roller is positioned on said vehicle such that said roller is positioned to rollably couple said vehicle to said tube, wherein said motor is positioned to motivate rotation of said roller such that said vehicle is compelled along said rail within said internal space.

2. The toy of claim 1, further including said tube having an interior surface, said interior surface being textured.

3. The toy of claim 1, further including said tube comprising a plurality of interlocking sections.

4. The toy of claim 3, further including said plurality of interlocking sections comprising:

a plurality of linear segments;

a plurality of curved segments; and wherein said plurality of interlocking sections is selectively positionable such that said tube is selectively shapeable.

5. The toy of claim 4, further including at least one loading segment, said at least one loading segment being configured for opening and closing such that said internal space of said at least one loading segment is accessible to a user.

6. The toy of claim 5, further including said at least one loading segment comprising a cover and a base, said cover being spring-hingedly coupled to said base such that said cover is biased to a closed configuration, wherein said cover is positioned on said base such that said cover is configured for opening.

7. The toy of claim 3, further including each said interlocking section comprising:

a plurality of first couplers coupled to a first end of said interlocking section;

a plurality of second couplers coupled to a second end of said interlocking section, said second couplers being complementary to said first couplers; and wherein said second couplers are positioned on said second end such that said second couplers are positioned to couple to said first couplers of an adjacently positioned said interlocking section to couple said interlocking sections.

8. The toy of claim 7, further comprising:

said first coupler comprising a hole positioned through a tab coupled to and extending from said first end; and said second coupler comprising a protrusion coupled to and extending from an exterior surface of said tube proximate to said second end, said protrusion being complementary to said hole.

9. The toy of claim 7, further comprising:

said first coupler comprising a pin coupled to and extending from said first end; and said second coupler comprising a channel positioned into said tube, said channel extending inwardly into said tube from said second end, said channel being complementary to said pin.

10. The toy of claim 3, further including a plurality of flanges, each said flange being coupled to and extending from said first end of a respective said interlocking section, wherein said flange is positioned on said first end such that said flange is positioned for insertion of a respective said second end of an adjacently positioned said interlocking section.

11. The toy of claim 1, further including said vehicle being train shaped.

12. The toy of claim 1, further including said drive ball being studded, such that said drive ball is positioned to grip said interior surface of said tube.

13. The toy of claim 1, further including a retainer coupled to and extending from said bottom of said vehicle, said retainer being slidably coupled to said rail, wherein said retainer is positioned on said vehicle such that said retainer is positioned to maintain said vehicle on said rail as said vehicle is motivated along said rail by said motor.

14. The toy of claim 1, further including a retainer comprising:

a rod coupled to and extending from said bottom of said vehicle;

a crosspiece coupled to said rod distal from said vehicle;

a pair of extensions coupled to and extending from said crosspiece, each said extension being positioned proximate to a respective opposing endpoint of said crosspiece;

a pair of wheels, each said wheel being axially coupled to a respective said extension, wherein said wheel is positioned on said extensions such that said wheel is positioned in a respective said slot, such that said vehicle is rollably coupled to said rail;

a pair of bearings coupled to said crosspiece and extending to said second plate, wherein said bearings are positioned on said crosspiece such that said bearings are positioned to separate said retainer from said rail; and wherein said retainer is positioned on said vehicle such that said retainer is positioned to maintain said vehicle on said rail as said vehicle is motivated along said rail by said motor.

15. A track toy comprising:

a tube defining an internal space, said tube having an interior surface, said interior surface being textured, said tube comprising a plurality of interlocking sections, said plurality of interlocking sections comprising a plurality of linear segments and a plurality of curved segments such that said plurality of interlocking sections is selectively positionable such that said tube is selectively shapeable, said plurality of interlocking sections comprising at least one loading segment, said at least one loading segment being configured for opening and closing such that said internal space of said at least one loading segment is accessible to a user, said at least one loading segment comprising a cover and a base, said cover being spring-hingedly coupled to said base such that said cover is biased to a closed configuration, wherein said cover is positioned on said base such that said cover is configured for opening, each said interlocking section comprising:

a plurality of first couplers coupled to a first end of said interlocking section, said first coupler comprising a hole positioned through a tab coupled to and extending from said first end, said first coupler comprising a pin coupled to and extending from said first end, a plurality of second couplers coupled to a second end of said interlocking section, said second couplers being complementary to said first couplers, said second coupler comprising a protrusion coupled to and extending from an exterior surface of said tube proximate to said second end, said protrusion being complementary to said hole, said second coupler comprising a channel positioned into said tube, said channel extending inwardly into said tube from said second end, said channel being complementary to said pin, and wherein said second couplers are positioned on said second end such that said second couplers are positioned to couple to said first couplers of an adjacently positioned said interlocking section to couple said interlocking sections;

a rail coupled to said tube and positioned in said internal space, said rail being configured to couple to a source of electric power, said rail comprising:

a first plate coupled to extending perpendicularly from said tube, a second plate coupled to said first plate distal from said tube, said first plate being positioned equally distant from opposing edges of said second plate, a pair of connectors, each said connector being positioned longitudinally proximate to a respective said opposing edge, and wherein each said second plate, said first plate and said interior surface of said tube define a pair of slots;

a vehicle slidably coupled to said rail, said vehicle being train shaped;

a roller coupled to a bottom of said vehicle, wherein said roller is positioned on said vehicle such that said roller is positioned to rollably couple said vehicle to said tube, said roller comprising:

a pair of arms coupled to and extending from said bottom of said vehicle, an axle coupled to and extending between said arms distal from said bottom, a drive ball coupled to said axle, said axle being centrally positioned through said drive ball, said drive ball being studded, such that said drive ball is positioned to grip said interior surface of said tube, a groove positioned in said drive ball, said groove being substantially complementary to said rail, wherein said groove is positioned in said drive ball such that said groove is positioned for said rail to pass through said groove as said drive ball rotates along said rail, a pair of annular rings coupled said drive ball within said groove, said annular rings being metallic, wherein each said annular ring is positioned in said groove such that said annular ring is positioned to electrically couple to a respective said connector of said rail;

a motor coupled to and positioned in said vehicle, said motor being operationally coupled to said rail and said roller;

a retainer coupled to and extending from said bottom of said vehicle, said retainer being slidably coupled to said rail, wherein said retainer is positioned on said vehicle such that said retainer is positioned to maintain said vehicle on said rail as said vehicle is motivated along said rail by said motor, said retainer comprising:

a rod coupled to and extending from said bottom of said vehicle, a crosspiece coupled to said rod distal from said vehicle, a pair of extensions coupled to and extending from said crosspiece, each said extension being positioned proximate to a respective opposing endpoint of said crosspiece, a pair of wheels, each said wheel being axially coupled to a respective said extension, wherein said wheel is positioned on said extensions such that said wheel is positioned in a respective said slot, such that said vehicle is rollably coupled to said rail, and a pair of bearings coupled to said crosspiece and extending to said second plate, wherein said bearings are positioned on said crosspiece such that said bearings are positioned to separate said retainer from said rail;

a plurality of flanges, each said flange being coupled to and extending from said first end of a respective said interlocking section, wherein said flange is positioned on said first end such that said flange is positioned for insertion of a respective said second end of an adjacently positioned said interlocking section; and wherein said plurality of interlocking sections is selectively positionable such that said tube is selectively shapeable, wherein said at least one loading segment is configured for opening and closing such that said internal space is accessible to a user, wherein said roller is positioned on said vehicle such that said roller is positioned to rollably couple said vehicle to said tube, wherein said motor is positioned to motivate rotation of said roller such that said vehicle is compelled along said rail within said internal space, wherein said retainer is positioned on said vehicle such that said retainer is positioned to maintain said vehicle on said rail as said vehicle is motivated along said rail by said motor.

* * * * *